US006100492A

United States Patent [19]

Zehnder et al.

[11] Patent Number: 6,100,492

[45] Date of Patent: Aug. 8, 2000

[54] CONSUMABLE SWITCHING ARRANGEMENT

[75] Inventors: Lukas Zehnder, Baden-Dättwil; Robert Anderes, Siebnen, both of Switzerland; Christian Dähler, Greensburg, Pa.; Kurt Kaltenegger, Lengnau; Thomas Schoenemann, Buchs, both of Switzerland

[73] Assignee: Asea Brown Boveri AG, Baden, Switzerland

[21] Appl. No.: 09/290,387

[22] Filed: Apr. 13, 1999

[30] Foreign Application Priority Data

Apr. 14, 1998 [DE] Germany ..... 198 16 509

[51] Int. Cl.[7] ..... H01H 33/12; H01H 33/66; H01H 33/985

[52] U.S. Cl. ..... 218/146; 218/18; 218/49; 218/65; 218/74

[58] Field of Search ..... 218/17–23, 30–33, 218/48–50, 65, 74, 146, 147; 200/243, 252–261

[56] References Cited

U.S. PATENT DOCUMENTS

| | | | |
|---|---|---|---|
| 4,152,560 | 5/1979 | McCloud et al. | 218/49 |
| 4,371,765 | 2/1983 | Ragaller | 218/22 |
| 4,486,632 | 12/1984 | Niemeyer et al. | 218/57 |
| 5,495,084 | 2/1996 | Meyer et al. | 218/43 |
| 5,902,978 | 5/1999 | Zehnder et al. | 218/57 |
| 5,929,409 | 7/1999 | Zehnder et al. | 218/48 |
| 5,981,893 | 11/1999 | Bleiker et al. | 218/48 |

FOREIGN PATENT DOCUMENTS

| | | |
|---|---|---|
| 0033355A1 | 8/1981 | European Pat. Off. . |
| 0177714B1 | 4/1986 | European Pat. Off. . |
| 2423103C2 | 9/1986 | Germany . |

*Primary Examiner*—J. R. Scott
*Attorney, Agent, or Firm*—Burns, Doane, Swecker & Mathis, L.L.P.

[57] ABSTRACT

A wreath of contact fingers (4) directed radially toward a switching axis (1) presses in the closed position against the circumferential surface of a contact pin (2) with consumable heads (5) fitted on the ends. At an angle of approximately 90°, the contact fingers (4) adjoin webs (6) which are guided in the closing direction up to a housing part (7) at which they are permanently anchored and via which they connect the contact fingers (4) to an electric terminal. The webs (6) and—with the exception of the consumable heads (5)—the contact fingers (4) are produced in one piece from springy material of high conductivity. The contact with the contact pin (2) radially deflects the consumable heads (5) in the closing direction with elastic bending of the webs (6). The length (R) of the radial contact fingers and the length (L) of the axial webs (6) are selected such that the attraction of the parallel component currents through the latter approximately compensates the contact repulsion forces.

20 Claims, 10 Drawing Sheets

CONSUMABLE SWITCHING ARRANGEMENT

BACKGROUND OF THE INVENTION

1. Field of the Invention

The invention relates to a consumable switching arrangement, in particular for circuit-breakers such as those used in power plants, transformer substations and other facilities of electric supply for the purpose of connecting and disconnecting operating currents and overcurrents.

2. Discussion of Background

EP-B-0 177 714 has disclosed a generic consumable switching arrangement in which the first contact member is constructed as a contact tulip having a plurality of lengthy parallel contact fingers distributed over the circumference thereof. It has been found that for high currents such an arrangement is susceptible to damage, since the contact fingers conduct parallel currents at a small spacing and are therefore drawn very strongly toward one another by electromagnetic forces. This can lead to bending and twisting of the contact fingers. Again, the friction forces between the contact pin and contact fingers can thereby reach very high values, with the result that large drive forces are required and intense abrasion occurs on the contact pin and the contact fingers.

SUMMARY OF THE INVENTION

Accordingly, one object of the invention is to provide a novel consumable switching arrangement in which the contact members are not mechanically overloaded even in the case of high currents, and no excessive contact pressure is produced.

This is achieved by having a contact part which includes a plurality of contact elements, with a portion of each contact element extending parallel to the switching axis, and the parallel portions being spaced apart from one another a predetermined distance so as to substantially avoid being drawn together by the influence of electromagnetic forces. This configuration thereby ensures that the current paths through the contact elements are not guided in parallel at a short distance from one another, but rapidly run apart from one another starting from the contact zone and at most are subsequently guided in parallel at a relatively large spacing so that no excessively large forces act on the contact elements. By contrast, the attractive forces need not be completely suppressed; on the contrary, by appropriate guidance of the current paths, said forces can be set such that they contribute to the required contact pressure between the contact elements and the contact pin and preferably more or less approximately compensate the contact repulsion forces.

BRIEF DESCRIPTION OF THE DRAWINGS

A more complete appreciation of the invention and many of the attendant advantages thereof will be readily obtained as the same becomes better understood by reference to the following detailed description when considered in connection with accompanying drawings, wherein.

DESCRIPTION OF THE PREFERRED EMBODIMENTS

Figure 1:
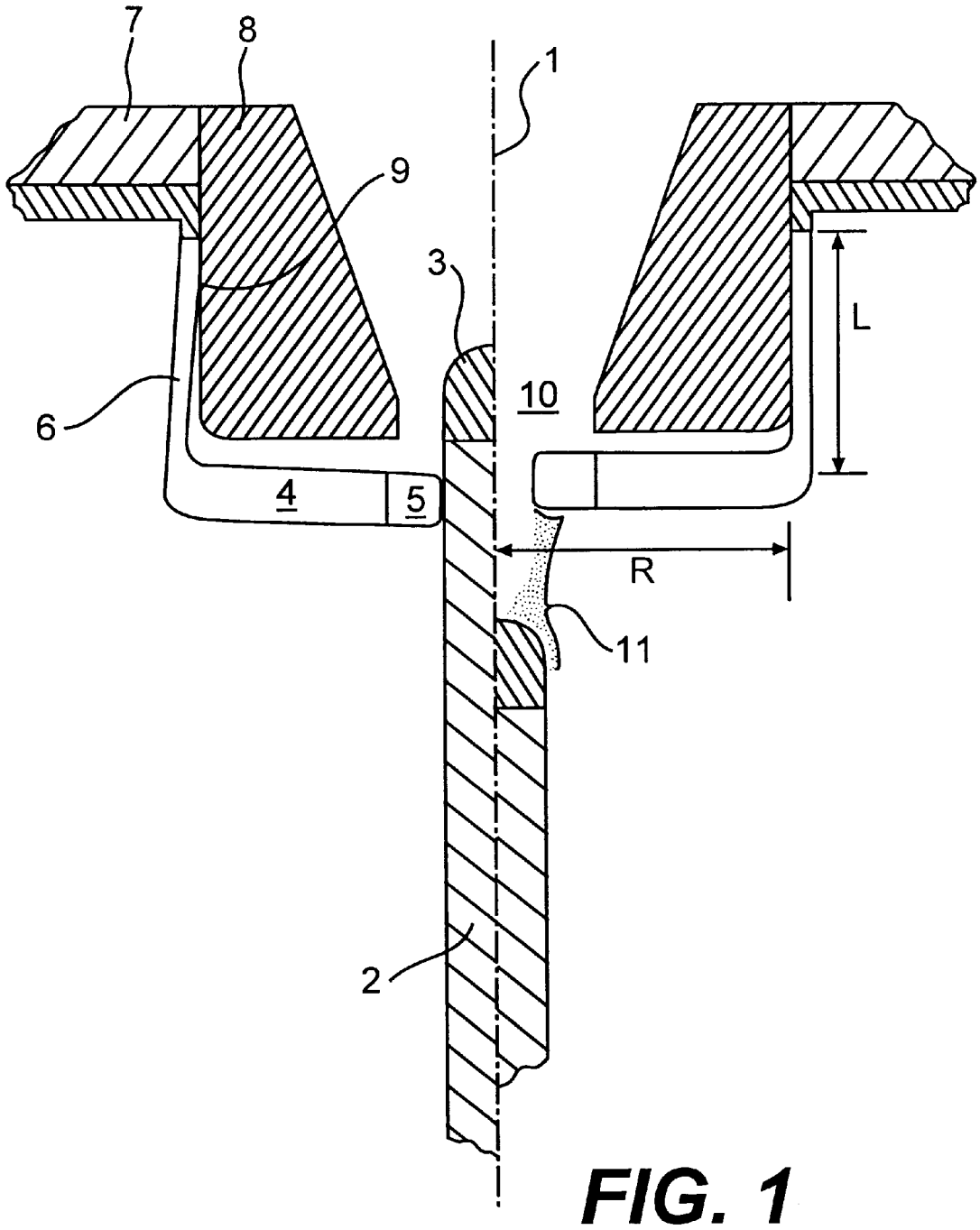
FIG. 1 shows an axial longitudinal section through a consumable switching arrangement in accordance with a first embodiment of the invention—on the left in the closed position and on the right in the open position.

Referring now to the drawings, wherein like reference numerals designate identical or corresponding parts throughout the several views, the consumable switching arrangement in accordance with a first embodiment of the invention and represented in FIG. 1 is constructed to be approximately rotationally symmetrical about a switching axis 1. A contact pin 2 with a tip 3 made from a material resistant to arc erosion such as, for example, WCu, graphite, CFC, graphite/Cu or CFC/Cu can be displaced along the switching axis 1 between the closed position shown on the left and the open position shown on the right by means of a switching drive (not represented). A first contact member comprises a wreath of contact elements which are arranged around the switching axis 1 and directed radially toward the latter, and are constructed as elongated contact fingers 4 which bear at their ends consumable heads 5 made from a material resistant to arc erosion.

Together, the contact fingers 4 form an approximately annular contact part, the contact surfaces, directed toward the switching axis 1, of the consumable heads 5 constituting a contact zone bearing in the closed position against the outside of the contact pin 2. Disregarding the consumable head 5, each contact finger 4 is produced from a web 6, which is made from a springy material of high conductivity and is bent away in the closing direction by approximately 90°, that is to say encloses a right angle with the contact finger 4, and permanently anchored on a housing part 7 via which the web 6 is connected to a first electric terminal. By contrast, the contact pin 2 forms a second contact member which is connected to a second electric terminal, for example via a flexible lead or a sliding tulip.

Fastened in an opening in the housing part 7 is a support body 8 made from an electrically insulating material, whose outside in the shape of a lateral cylindrical surface forms a supporting surface 9 against which the webs 6 bear in the open position. By contrast, in the closed position the contact fingers 4 are deflected radially outwards by the contact of the consumable heads 5 with the circumferential surface of the contact pin 2 together with elastic deformation of the webs 6, which are raised by the supporting surface 9. Because of the high elasticity of the webs 6, in this case the initial deflection can be selected to be quite large, with the result that a large consumption reserve is available. In the middle, the support body 8 has an opening which forms a nozzle 10 which surrounds the switching axis 1 and into which the tip 3 of the contact pin 2 projects in the closed position.

If, in the course of a disconnection, the current commutates from a nominal current switching arrangement (not represented) to the consumable switching arrangement, following the contact zone the current flows in the radial direction through the contact fingers 4. It is only at a relatively large spacing R from the switching axis 1 that it is deflected into a direction parallel to the same and flows through the parallel webs 6 over a distance L.

The radially outwardly directed parts of the current paths in the contact fingers 4 exert a relatively slight electromagnetic force on one another, and it is also possible to neglect the action on the same of the section of the current path running through the contact pin 2. Although the subsequent parallel current paths through the webs 6 attract one another, because of the relatively large spacing from the switching axis 1, the radial component of the attraction is not so large for it to be feared that damage or an excessively high pressure of the contact fingers 4 against the contact pin 2 could lead to excessive abrasion of the consumable heads 5 and impeding of the movement of the contact pin.

On the contrary, the spacing R of the web 6 from the switching axis 1, and the length L thereof can be set such that given the current intensities normally to be expected, the mutual attraction of the contact fingers 4 boosts in a desired way the contact pressure exerted by the contact fingers 4 against the contact pin 2 because of their elastic deflection, and in particular approximately compensates the contact repulsion forces active between said parts. Such a compensation is maintained over all fluctuations in the current intensity, since contact repulsion forces and attractive forces depend in the same way on the same. In the further movement of the contact pin 2, the same is drawn from the wreath of the contact fingers 4, and the consumable heads 5 of the same move toward the switching axis 1 until the webs 6 bear against the supporting surface 9. Further radial movement of the contact fingers 4 toward the switching axis 1 under the influence of the mutual attraction of the current tracks through the webs 6 is thereby suppressed.

An arc 11 is produced between the consumable heads 5 and the tip 3 of the contact pin 2 as soon as the latter is drawn out of the wreath of the contact fingers 4. It is blown out, for example by means of puffers (not represented), the gas flowing off through the nozzle 10, with the result that it is extinguished at the next current zero.

Figure 2:
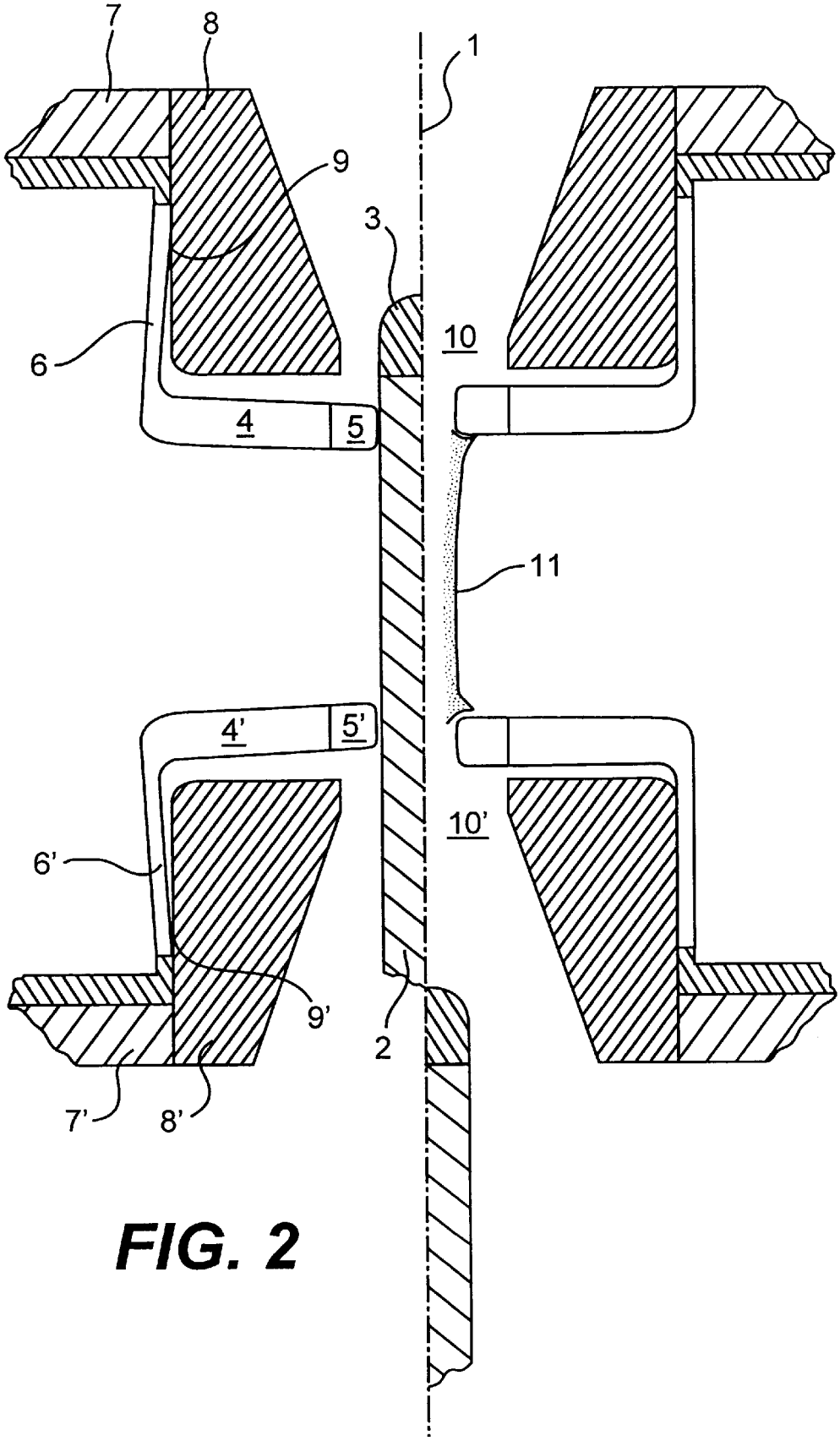
FIG. 2 shows an axial longitudinal section through a consumable switching arrangement in accordance with a second embodiment of the invention, on the left in the closed position and on the right in the open position

As concerns the first contact member, the consumable switching arrangement in accordance with a second embodiment of the invention and represented in FIG. 2 corresponds completely to the first embodiment. However, the second contact member comprises in addition to the contact pin 2 a consumable contact arrangement which corresponds in turn exactly to the first contact member, having contact fingers 4' with consumable heads 5' which press in the closed position against the circumferential surface of the contact pin 2 with their inner surfaces, which form a second contact zone, the contact fingers 4' in turn adjoining webs 6' at an angle of approximately 90° and being connected via the same and a housing part 7' to the second electric terminal, with the result that the contact fingers 4' simultaneously assume the function of a sliding tulip. In the open position, the webs 6' in turn bear against a supporting surface 9' which is formed by the outside of a support body 8' which simultaneously forms a nozzle 10' surrounding the switching axis 1.

During disconnection, as soon as the contact pin 2 is drawn from the wreath of the contact fingers 4' the arc 11 commutates from the tip 3 of said pin onto the consumable heads 5' of the contact fingers 4', so that it then burns between the latter and the consumable heads 5 of the contact fingers 4 of the first contact member. When the arc 11 is blown out, the gas flows off through the two nozzles 10, 10', and this promotes rapid extinguishing of the arc.

Figure 3:
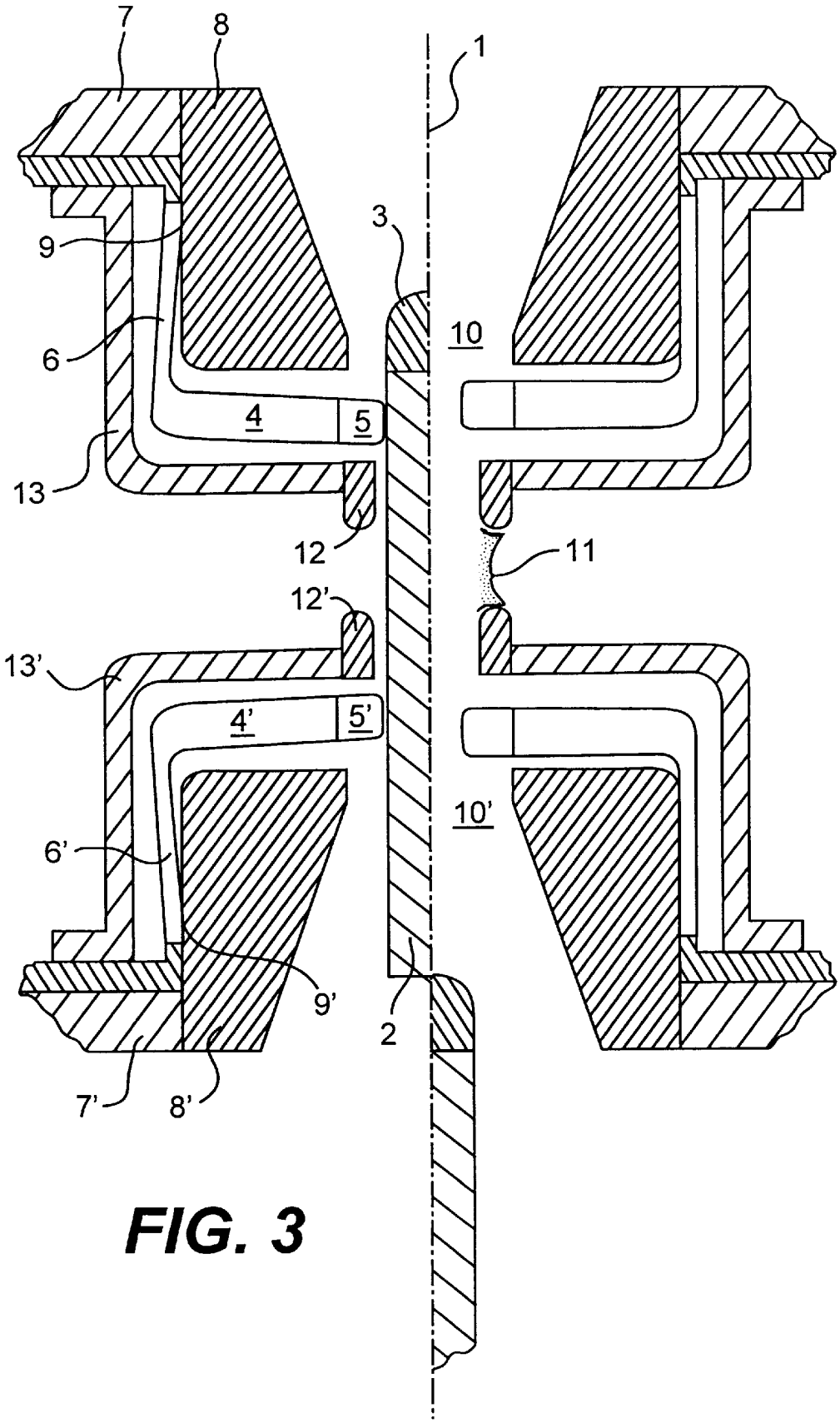
FIG. 3 shows an axial longitudinal section through a consumable switching arrangement in accordance with a third embodiment of the invention, on the left in the closed position and on the right in the open position.

The consumable switching arrangement in accordance with the third embodiment of the invention represented in FIG. 3 corresponds otherwise completely to that in accordance with the second embodiment, but the contact fingers 4, 4' are each provided at the front with consumable rings 12, 12'. They form parts of pot-shaped shields 13, 13' which, connected in an electrically conductive fashion to the webs 6 and 6', respectively, in each case surround the remaining parts of the contact members and completely shield them. During disconnection, the arc 11 rapidly commutates from the consumable heads 5 of the contact fingers 4 onto the consumable ring 12, while it essentially commutates from the tip 3 of the contact pin 2 onto the consumable ring 12', and this reduces the erosion of the contact fingers 4, 4' and thus lengthens their service life.

Figure 4:
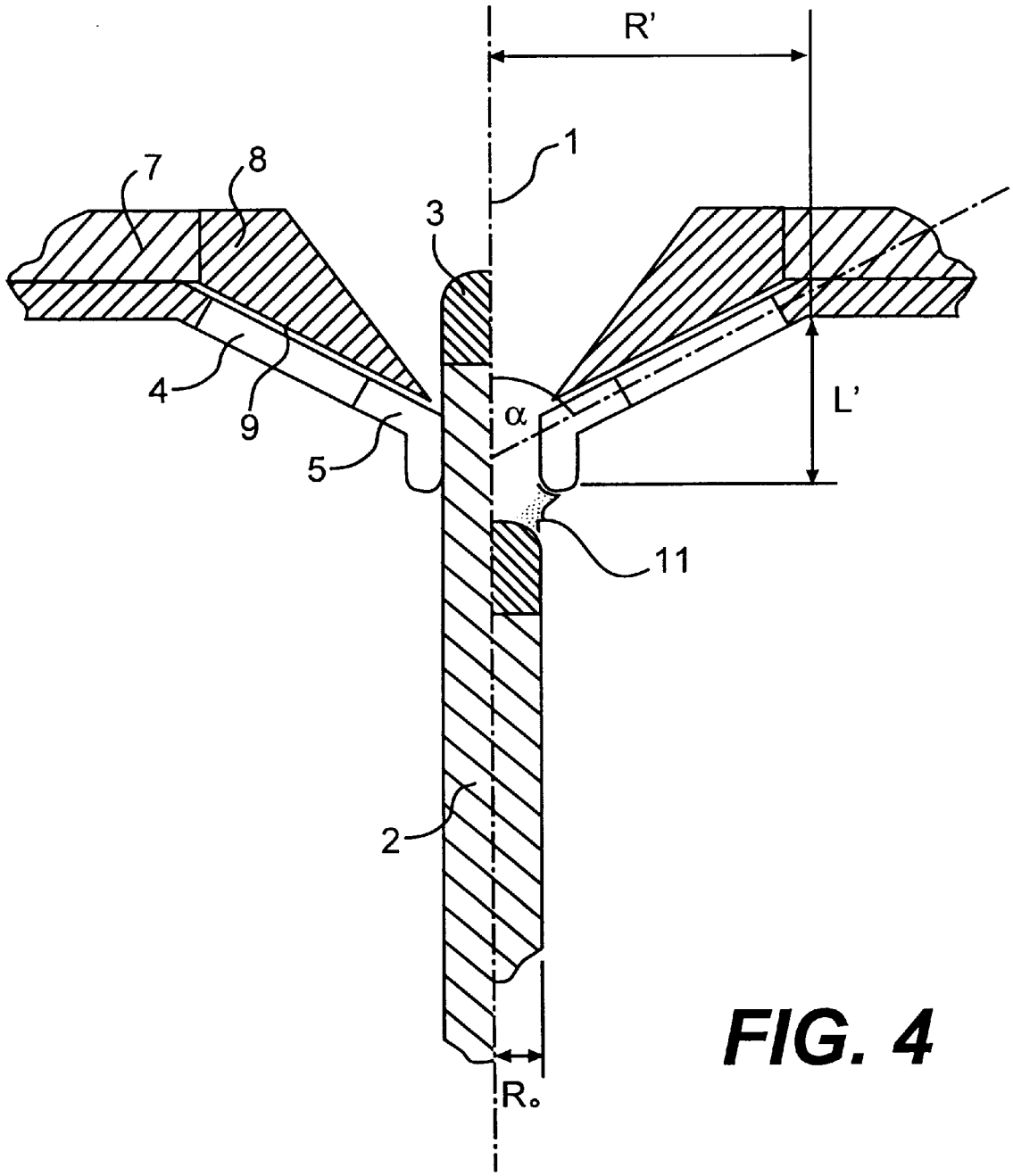
FIG. 4 shows an axial longitudinal section through a consumable switching arrangement in accordance with a fourth embodiment of the invention, on the left in the closed position and on the right in the open position.

The fundamental design of the consumable switching arrangement in accordance with a fourth embodiment of the invention and represented in FIG. 4 corresponds to that according to the first embodiment, but the contact fingers 4, which comprise the first contact member, are aligned such that they enclose an angle $\alpha$ where $\alpha$ is fragmented at of approximately 65° with the switching axis 1, and is at least 60° or at least 45° seen in the closing direction. With the exception of the relatively long consumable heads 5, they consist of springy material of high conductivity, are straight and are guided directly as far as the housing part 7 and anchored on the same, with the result that together they form an approximately funnel-shaped contact part.

Here, as well, the mutual attraction of the contact fingers 4 is reduced by virtue of the fact that the current paths rapidly diverge starting from the contact zone, that is to say the insides of the consumable heads 5 touching the contact pin 2. Said attraction can, in turn, be set via the length R' of the radial component of its extent and the radius $R_0$ of the contact pin 2 as well as the length L' of the axial component of its extent such that it does not lead to damage to the contact fingers, excessive abrasion of the consumable heads 5 or impeding of the movement of the contact pin, but contributes to building up an adequate contact pressure, in particular compensating the contact repulsion forces. In this case, the support body 8 forms a supporting surface 9 in the form of the lateral surface of a conical frustum, which is situated at a spacing below the contact fingers 4 and limits the ability of the latter to move toward the switching axis 1. The course of a disconnection corresponds to that outlined in conjunction with the consumable switching arrangement in accordance with the first embodiment of the invention.

Figure 5:
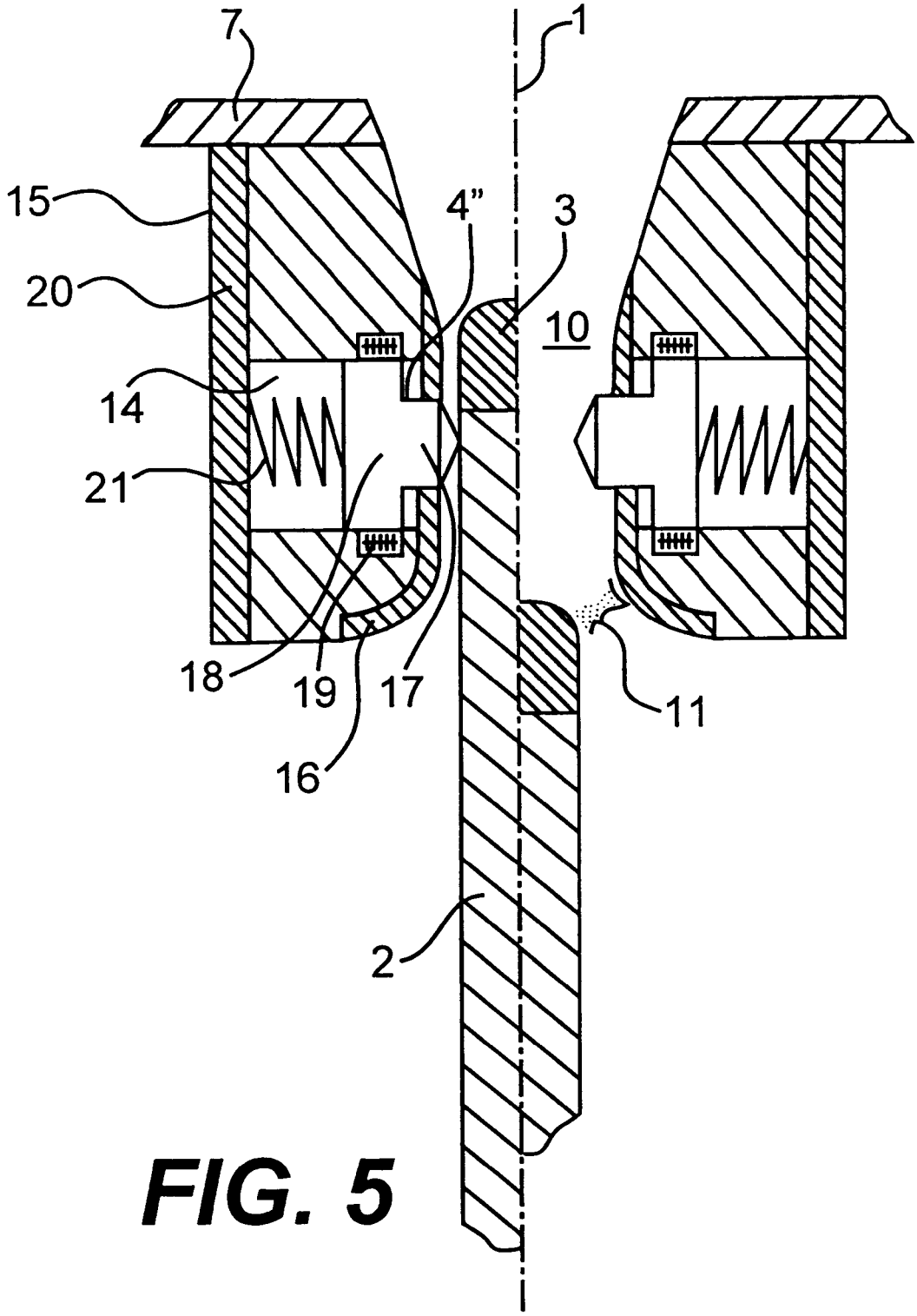
FIG. 5 shows an axial longitudinal section through a consumable switching arrangement in accordance with a fifth embodiment of the invention, on the left in the closed position and on the right in the open position.

In the case of a consumable switching arrangement in accordance with a fifth embodiment of the invention and represented in FIG. 5, the basic design corresponds in turn to that of the consumable switching arrangement in accordance with the first embodiment of the invention. However, instead of contact fingers, the contact elements are provided as contact pieces 4" which are mounted, preferably in a fashion capable of precisely radial displacement, in corresponding radial cutouts 14, open toward the switching axis 1, of a holding ring 15 which surrounds said switching axis 1 and is fastened on the housing part 7 and is connected in an electrically conducting fashion via the same to the first electric terminal, and which also forms the nozzle 10. Moreover, the holding ring 15 is of solid construction and consists of an electrically conductive material. On the inside, and also on the side directed in the open position toward the matching switching piece, the contact pin 2, it is provided with a cladding 16 made from a material resistant to arc erosion.

The contact pieces 4" only project through appropriate openings in the cladding 16 with tips 17 which are resistant to arc erosion at least at their front ends, while the same form a stop for front shoulders of their wider bodies 18. Contact laminations 19 make the electric contact with the holding ring 15. A force acting radially toward the switching axis 1 is applied to the contact piece 4" in each case by means of a spring element pressing toward its rear side, specifically a helical spring 21 which is supported on an outer cladding 20 of the holding ring 15 which seals the cutout 14.

Here, as well, the current paths are led away radially outwards from the contact zone, that is to say the front ends, touching the contact pin 2, of the tips 17 of the contact pieces 4", with the result that the electromagnetic forces which they exert on one another have no appreciable influence on the contact pressure with which the contact pieces 4" press against the circumferential surface of the contact pin 2. The necessary contact pressure is applied by the helical spring 21. During disconnection, the arc 11, which is drawn between the tip 3 of the contact pin 2 and the tips 17 of the contact pieces 4", commutates immediately from the latter onto the cladding 16, whose end region on the disconnection side thereby fulfills the function of a consumable ring prescribed for the contact pieces 4".

Figure 6:
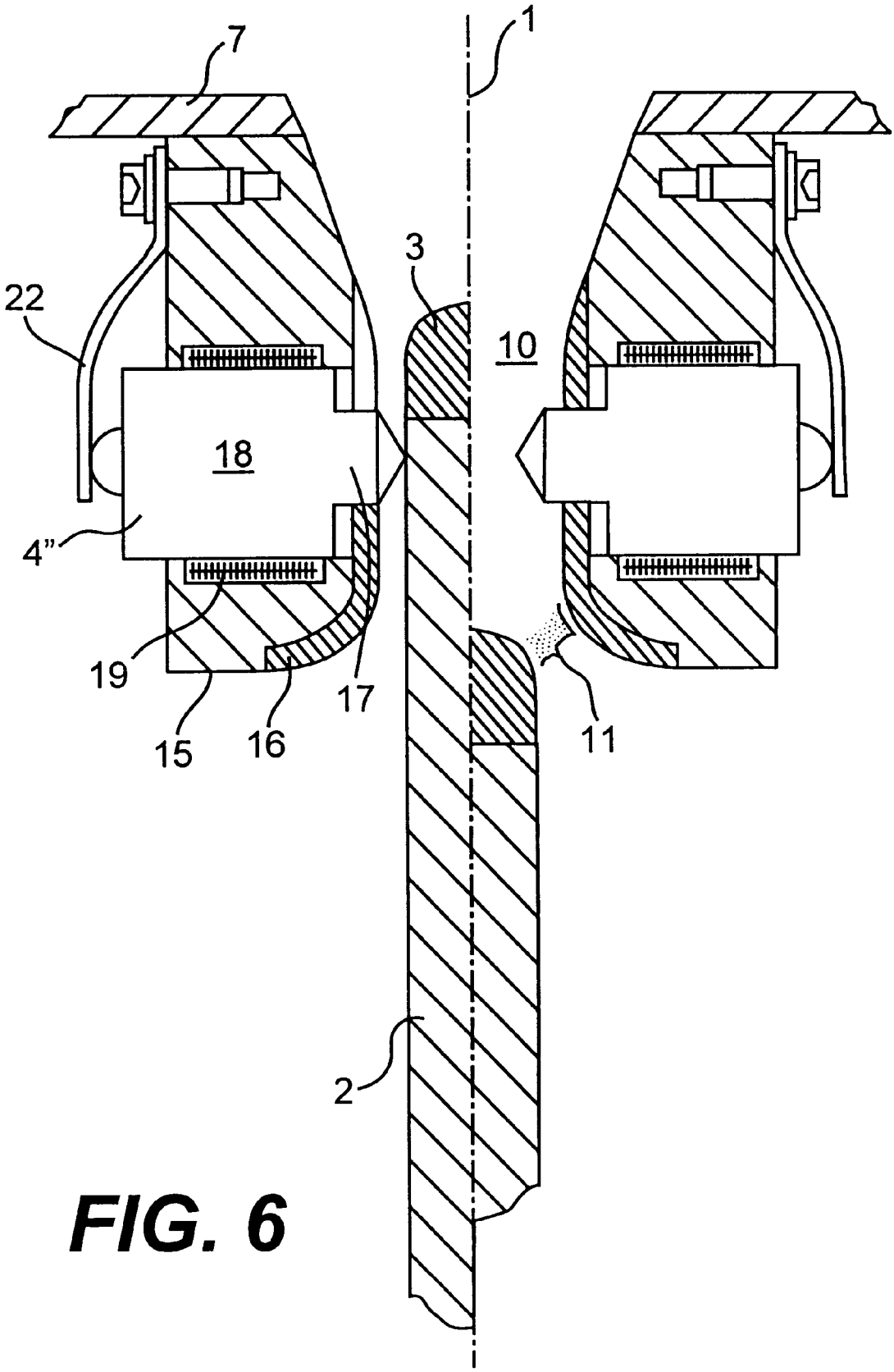
FIG. 6 shows an axial longitudinal section through a consumable switching arrangement in accordance with a sixth embodiment of the invention, on the left in the closed position and on the right in the open position.

The consumable switching arrangement in accordance with a sixth exemplary embodiment of the invention and represented in FIG. 6 largely corresponds to that described above, but the cutouts 14 are continuous, and the bodies 18 of the contact pieces 4" are so long that they project somewhat beyond the outside of the holding ring 15. A leaf spring 22 which presses against the rear side of the contact piece 4" is provided in each case as spring element.

Figure 7:
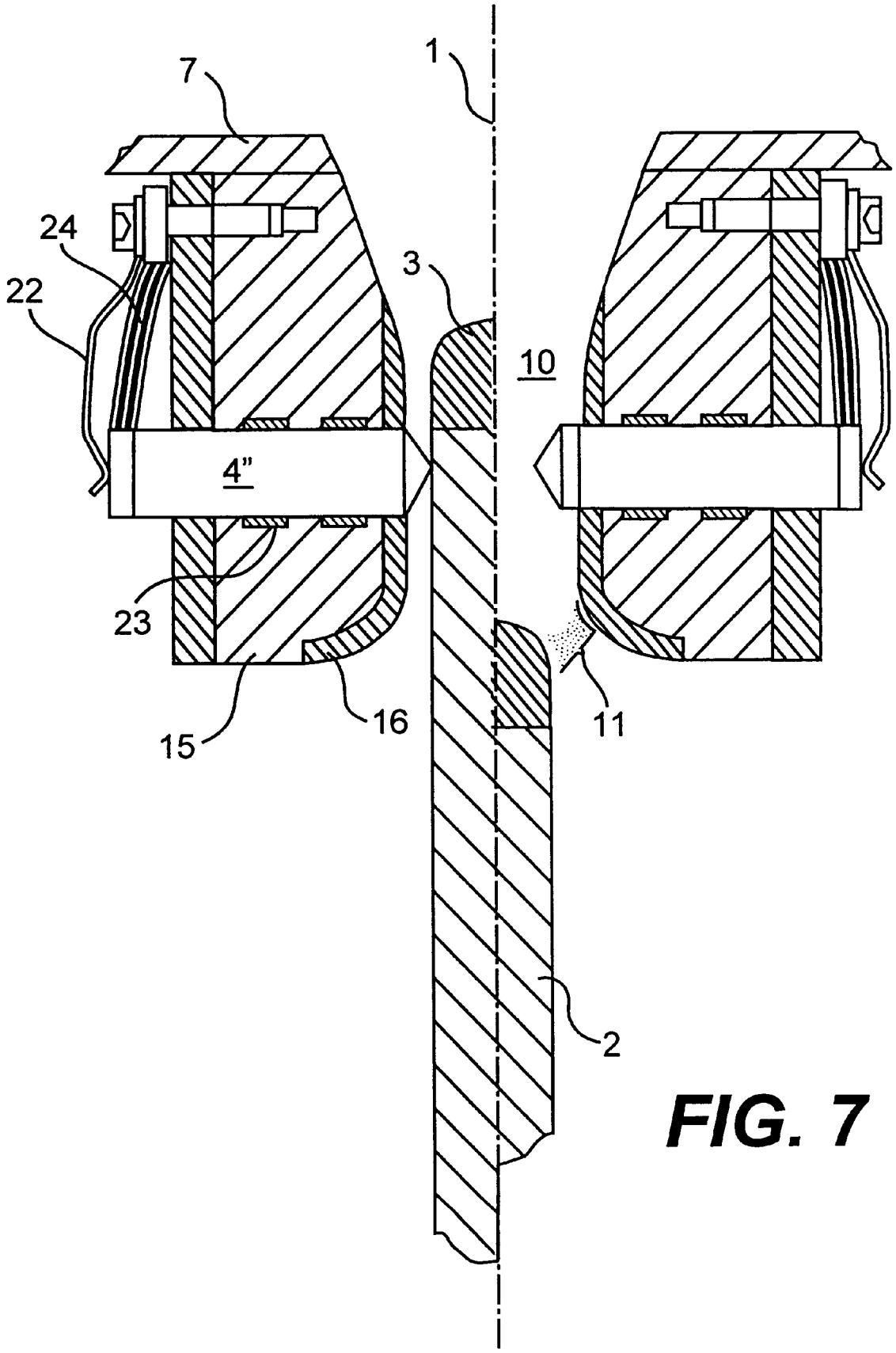
FIG. 7 shows an axial longitudinal section through a consumable switching arrangement in accordance with a seventh embodiment of the invention, on the left in the closed position and on the right in the open position.

The consumable switching arrangement in accordance with a seventh embodiment of the invention and represented in FIG. 7 corresponds, in turn, to that previously described, but the contact pieces 4" are of constant diameter and guided in each case in slideways 23 which are fitted in the cutouts 14. Again, the electric contact with the holding ring 15 is made here in each case via a flexible strip 24 which is made from a material of high conductivity and one end of 32 which is connected to the rear side of the contact piece 4" in an electrically conducting fashion, in particular is welded, while the other end is connected in an electrically conducting fashion to the holding ring 15.

Figure 8A:
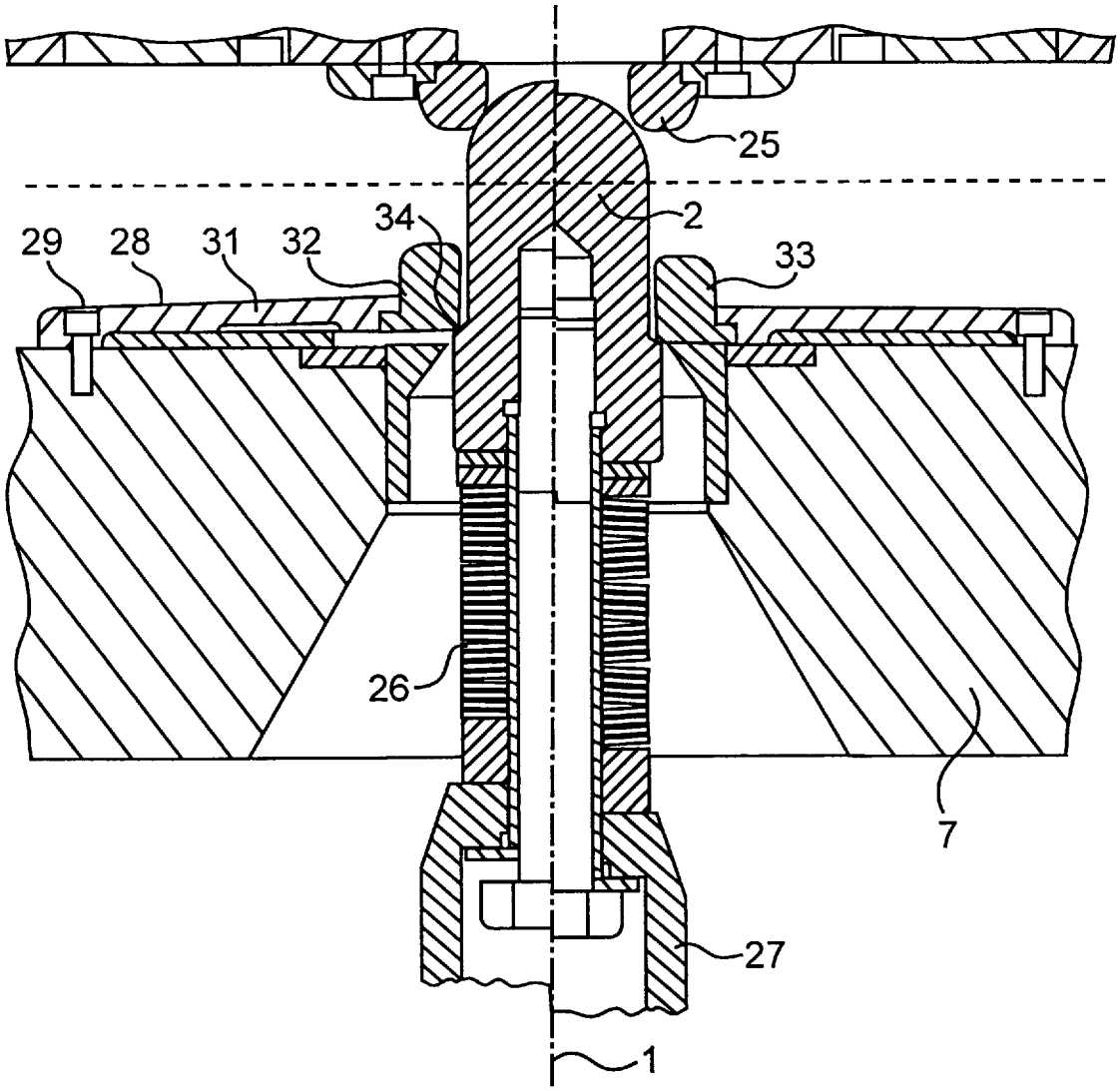
FIG. 8*a* shows an axial longitudinal section through a consumable switching arrangement in accordance with an eighth embodiment of the invention, on the left in the closed position and on the right shortly before reaching the closed position.
Figure 8B:
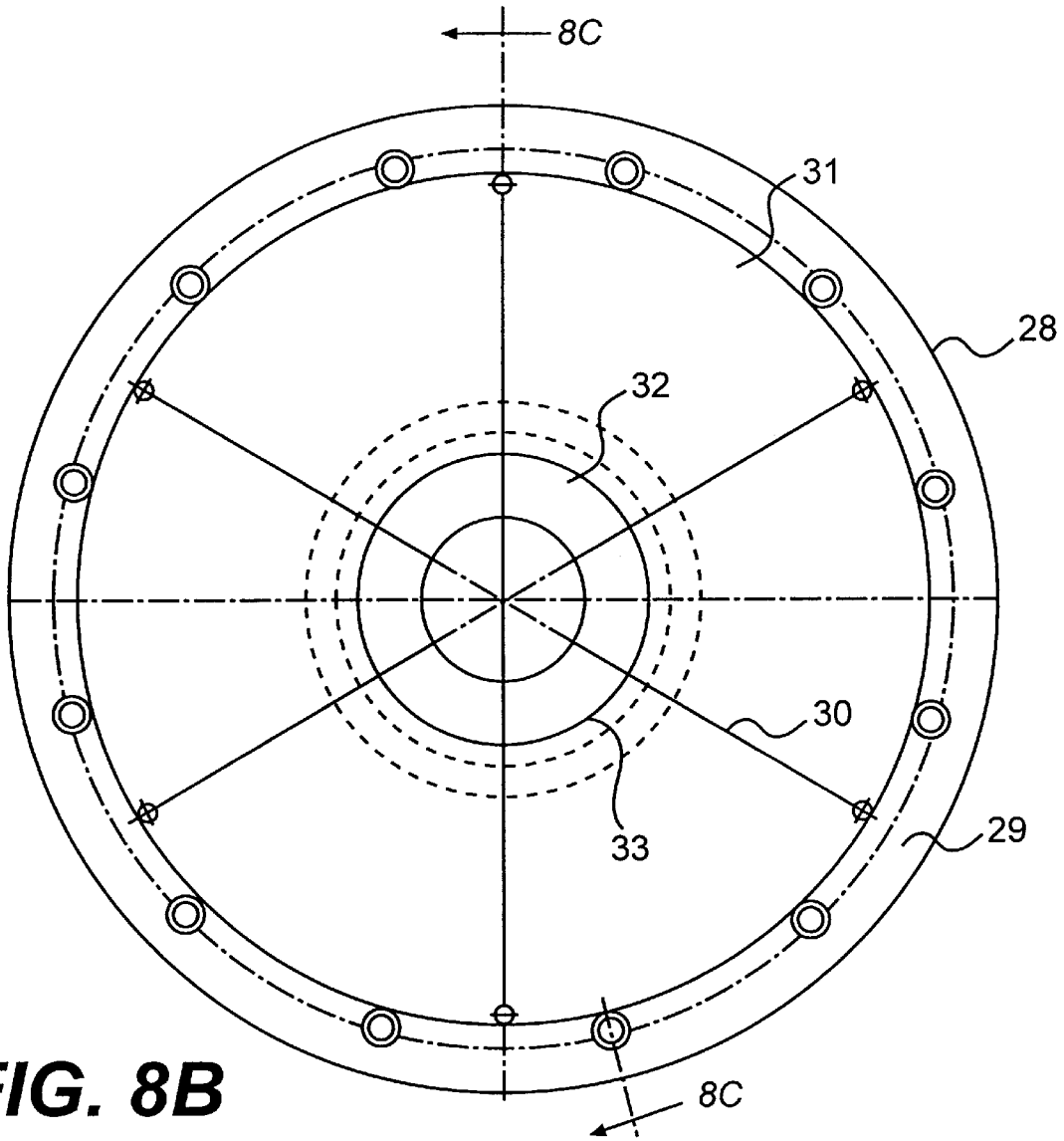
FIG. 8*b* shows an axial plan view of a part of the consumable switching arrangement according to FIG. 8*a*.
Figure 8C:
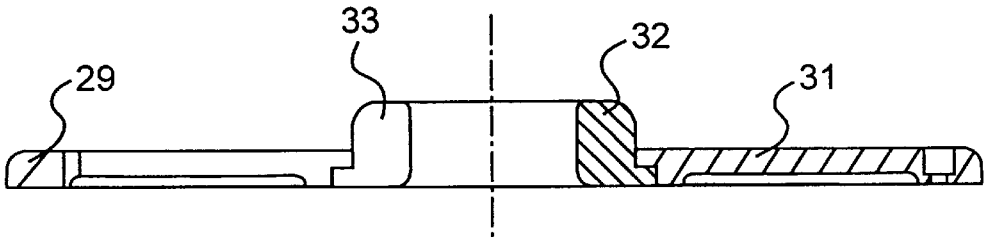
FIG. 8*c* shows a section along 8C—8C in FIG. 8*b*.

In accordance with an eighth embodiment of the invention represented in FIGS. 8*a–c*, the first contact member is constructed as a rigid first contact ring 25, made from a material resistant to arc erosion, which is fastened in the housing and connected via the same to the first electric terminal, again in an electrically conducting fashion. The second contact member comprises a contact pin 2 which, in a fashion supported by a cup-spring pack 26 which can be compressed to a limited extent in the opening direction, is fastened in an axially displaceable fashion on a holder 27 which can be displaced along the switching axis 1 by a switching drive (not represented), as well as a contact piece which is constructed as a circular disk 28 made from a springy material of high conductivity, for example CuBe or CuCrZr. It has a continuous outer ring 29 which is bolted to the housing part 7 and, as contact elements, six sectors 31 separated by radial slits 30 running continuously from the central opening up to the outer ring 29. Each of the sectors 31 of the circular disk 28 bears on its inner edge a sector 32, consisting of a material resistant to arc erosion, of a second contact ring 33. The outer ring 29 is connected in an electrically conducting fashion to the second electric terminal via the housing part 7.

The contact pin 2 has a circumferential shoulder 34 which is offset in the opening direction with respect to its tip by approximately the spacing between the first contact ring 25 and the second contact ring 33. In the closed position, the tip of the contact pin 2, to which a sufficient contact pressure is applied by the compressed cup-spring pack 26 bears all round against the front side of the first contact ring 25, while the shoulder 34 presses against a contact zone on the second contact ring 33 and lightly deflects the sectors 32 of the same axially in the closing direction, accompanied by elastic deformation of the sectors 31 of the circular disk 28, with the result that the elastic restoring forces of the sectors 31 ensure an adequate contact pressure here, as well.

Because of the essentially radial direction of the component current through the sectors 31, no electromagnetic forces which could essentially have an effect on the contact pressure occur on the circular disk 28. Because of the rigid construction of the first contact ring 25 there is in any case no risk of deformations or other damage due to electromagnetic forces in the region of the first contact member.

During disconnection, an arc is drawn between the first contact ring 25 and the tip of the contact pin 2. As soon as the tip of the contact pin 2 passes the second contact ring 33, the base of the arc jumps from the former onto the latter. The arc now connecting the first contact ring 25 and the second contact ring 33 is blown out laterally, the gas escaping through the two contact rings.

Figure 9:
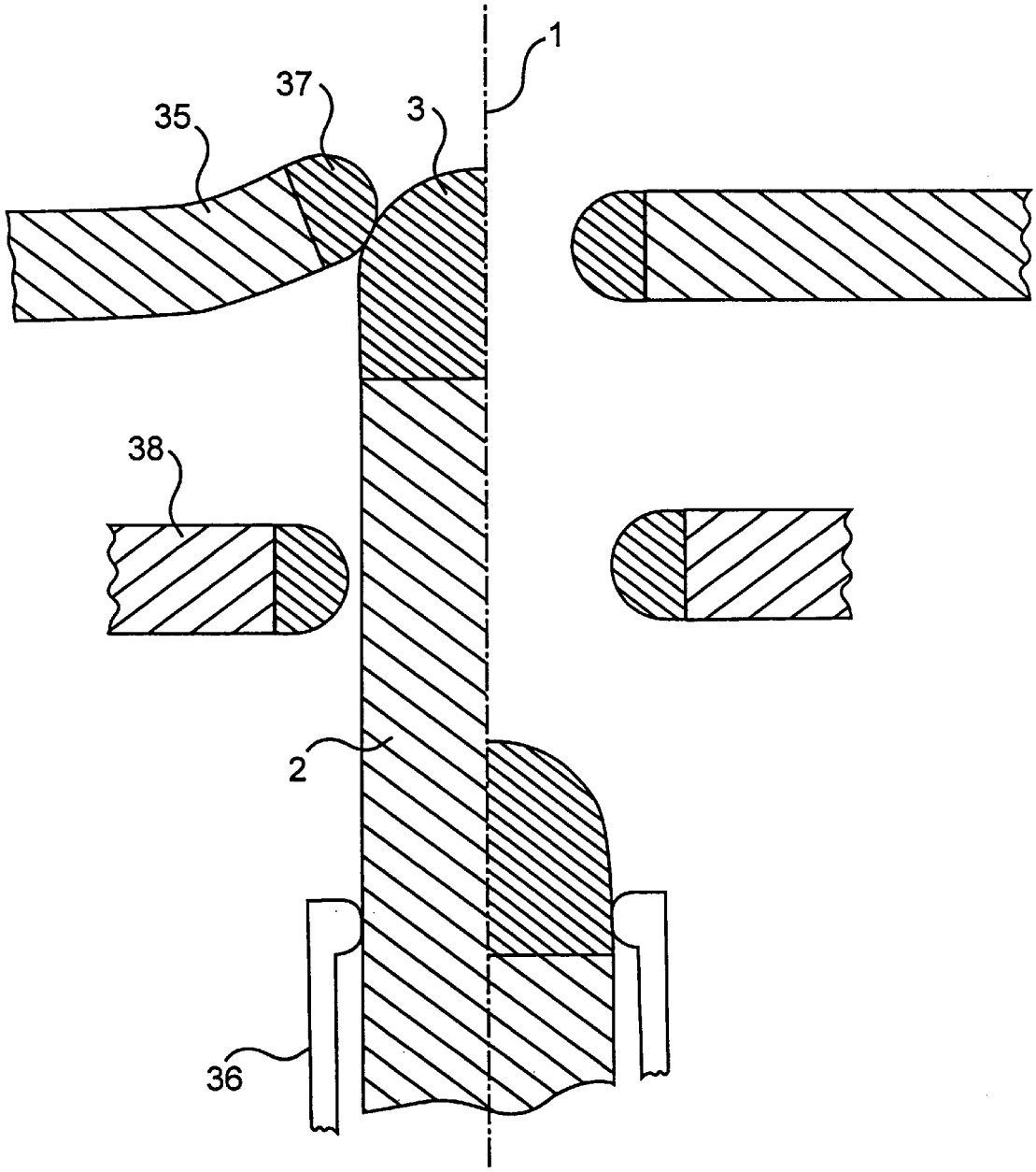
FIG. 9 shows an axial longitudinal section through a consumable switching arrangement in accordance with a ninth embodiment of the invention, on the left in the closed position and on the right in the open position.

The consumable switching arrangement in accordance with a ninth embodiment of the invention and represented diagrammatically in FIG. 9 is of similar construction to that previously outlined. However, here the first contact member is constructed as a first circular disk 35 which is slit from the inner edge and is made from a springy material of high conductivity. The contact pin 2 is fastened rigidly on a holder (not represented), which can be displaced along the switching axis 1 by a switching drive, and is connected via a sliding tulip 36 to the second electric terminal in an electrically conducting fashion. The elastic restoring force of the first circular disk 35, whose inner edge 37, made from a material resistant to arc erosion, forms a contact zone which is slightly deflected axially in the closing direction in the closed position, ensures adequate contact pressure. The second contact member comprises a rigid second circular disk 38 which is made from a material resistant to arc erosion and is connected in an electrically conducting fashion to the second electric terminal, and whose inside diameter is only slightly larger than the diameter of the contact pin 2. It acts as a consumable ring onto which one base of the arc jumps across from the contact pin 2 during disconnection.

Obviously, numerous modifications and variations of the present invention are possible in light of the above teachings. It is therefore to be understood that within the scope of the appended claims, the invention may be practiced otherwise than as specifically described herein.

What is claimed is:

1. A consumable switching arrangement in a housing, said switching arrangement comprising:

a first contact member, which is connected at least in one closed position to a first electric terminal, and a second contact member, which is connected at least in the closed position to a second electric terminal, said second contact member comprising a contact pin which can be displaced relative to the first contact member along a switching axis by means of a switching drive between so as to define a closed position, in which the first contact member touches the contact pin so that the consumable switching arrangement closes a current path between the first electric terminal and the second electric terminal, and an open position, in which the contact pin is spaced apart from the first contact member, and at least one of said first and second contact members including at least one contact part which touches the contact pin in the closed position to form a contact zone surrounding the switching axis, wherein the contact part circumferentially surrounds the switching axis, said contact part extending from an inner edge thereof which defines the contact zone, and widening as said contact part extends outward, such that it encloses an angle of at least 45° with the switching axis, and wherein the contact part includes a plurality of contact elements and a portion of each said contact element extends parallel to the switching axis, said parallel portions being spaced apart from one another a predetermined distance so as to substantially avoid being drawn together by the influence of electromagnetic forces.

2. The consumable switching arrangement as claimed in claim 1, wherein the angle between the switching axis and the contact part is at least 60°.

3. The consumable switching arrangement as claimed in claim 2, wherein the contact part is directed outwards from the switching axis at least approximately radially.

4. The consumable switching arrangement as claimed in claim 1, wherein, in the closed position, the contact zone is elastically deflected under the action of the contact pin.

5. The consumable switching arrangement as claimed in claim 4, wherein, in the closed position, the contact zone is deflected essentially axially and touches the contact pin at an impact surface pointing essentially in the closing direction.

6. The consumable switching arrangement as claimed in claim 5, wherein the contact elements comprise sectors, separated by slits, of a circular disk made from springy material, at whose inner edge the contact zone is formed.

7. The consumable switching arrangement as claimed in claim 6, wherein the slits run radially.

8. The consumable switching arrangement as claimed in claim 6, wherein the circular disk comprises a closed outer ring.

9. The consumable switching arrangement as claimed in claim 5, wherein the impact surface is formed by a circumferential shoulder of the contact pin.

10. The consumable switching arrangement as claimed in claim 5, wherein the impact surface is formed by the tip of the contact pin.

11. The consumable switching arrangement as claimed in claim 4, wherein, in the closed position, the contact zone is deflected essentially radially and touches the contact pin on its circumferential surface.

12. The consumable switching arrangement as claimed in claim 11, wherein the contact elements are constructed as contact pieces mounted in a radially displaceable fashion in a holder surrounding the contact pin in the closed position.

13. The consumable switching arrangement as claimed in claim 12, wherein the holder is constructed as a holding ring surrounding the switching axis and has, for the purpose of holding the contact pieces, radial cutouts which are open at least toward the switching axis.

14. The consumable switching arrangement as claimed in claim 1, wherein the plurality of contact elements are directed at least approximately rectilinearly toward the switching axis.

15. The consumable switching arrangement as claimed in claim 14, wherein each contact element is constructed as an elongated contact finger.

16. The consumable switching arrangement as claimed in claim 15, wherein each contact finger is at least approximately straight, and includes at least over a part of its length a flexible, springy material, and is permanently anchored at its end averted from the switching axis.

17. The consumable switching arrangement as claimed in claim 16, wherein each contact finger is directed obliquely toward the switching axis.

18. The consumable switching arrangement as claimed in claim 15, wherein each contact finger adjoins at an angle a web which is made from a flexible, in particular springy electrically conducting material, which forms at least a part of the electrically conducting connection between the contact finger and the corresponding electric terminal.

19. The consumable switching arrangement as claimed in claim 18, wherein the web is permanently anchored at least approximately parallel to the switching axis and at its end averted from the contact finger.

20. The consumable switching arrangement as claimed in claim 18, wherein, in the open position, at least one of the web and the contact finger bears against an outwardly pointing supporting surface.

* * * * *